US005351928A

United States Patent [19]

Cooper et al.

[11] Patent Number: 5,351,928

[45] Date of Patent: Oct. 4, 1994

[54] EASEL AND PAD PACK AND METHOD OF USE

[75] Inventors: John F. Cooper, Naperville; Kenneth A. Keeley, Chicago, both of Ill.

[73] Assignee: Wallace Computer Services, Inc., Hillside, Ill.

[21] Appl. No.: 13,630

[22] Filed: Feb. 4, 1993

[51] Int. Cl.[5] ..... A47B 97/04

[52] U.S. Cl. ..... 248/459; 248/461

[58] Field of Search ..... 248/444, 450, 459, 460, 248/461, 465; 40/124, 124.2

[56] References Cited

U.S. PATENT DOCUMENTS

| | | | |
|---|---|---|---|
| 433,635 | 8/1890 | Turck . | |
| 1,086,746 | 2/1914 | Babbitt | 248/461 X |
| 1,539,641 | 5/1925 | Brunhoff | 248/450 |
| 2,380,076 | 7/1945 | Scheyer | 248/459 X |
| 2,787,071 | 4/1957 | Friedman | 248/461 X |
| 3,088,738 | 5/1963 | Meyer | 248/461 X |
| 3,203,552 | 8/1965 | Solarz | 248/459 X |
| 3,226,863 | 1/1966 | Southard . | |
| 3,370,368 | 2/1968 | Paschal . | |
| 4,001,958 | 1/1977 | Fecko | 40/124.2 |
| 4,143,847 | 3/1979 | Cross | 248/459 |
| 4,213,520 | 7/1980 | Sarna | 248/461 X |

FOREIGN PATENT DOCUMENTS

| | | | |
|---|---|---|---|
| 2450584 | 3/1979 | France | 248/461 |

*Primary Examiner*—J. Franklin Foss

*Attorney, Agent, or Firm*—Tilton, Fallon, Lungmus & Chestnut

[57] ABSTRACT

An easel and pad pack and method including first and second generally rectangular, planar panels constructed of a unitary, folded paperboard to provide relatively stiff surfaces and having two pairs of opposite sides, tape closing the first and second panels temporarily on two opposite sides to provide an openable holder, the first and second panels being integral on the other two sides, an easel pad removably confined within said panels the first panel being equipped with a generally L-shaped cut defining a stand and arranged for pivotal movement out of the plane of the first panel to provide support for the holder, the first panel also being equipped with a generally C-shaped cut adjacent the L-shaped cut and defining brace means for stabilizing said stand means in non-planar relation to said first panel and an opening in said first panel for hand insertion to carry the pack.

7 Claims, 2 Drawing Sheets

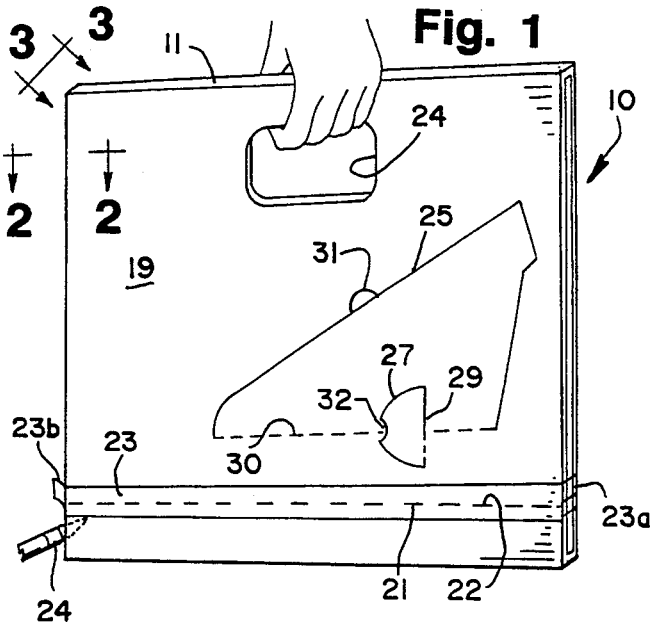
Fig. 1
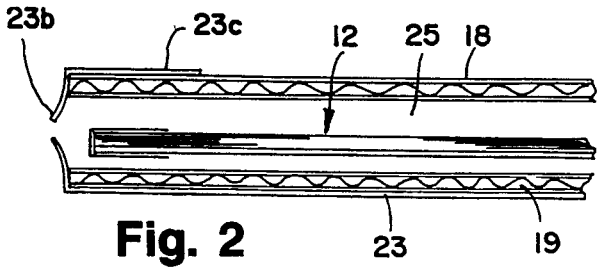
Fig. 2
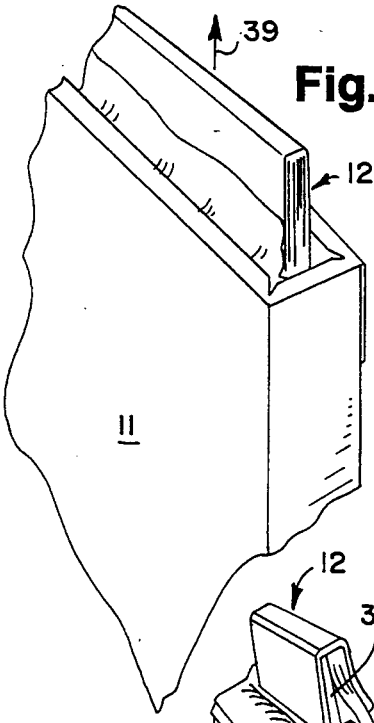
Fig. 3
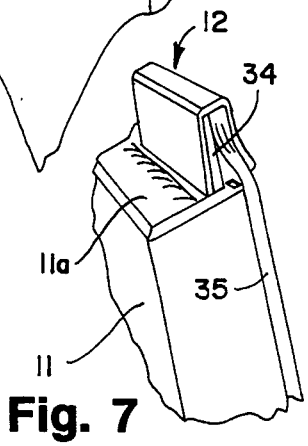
Fig. 7
Fig. 4
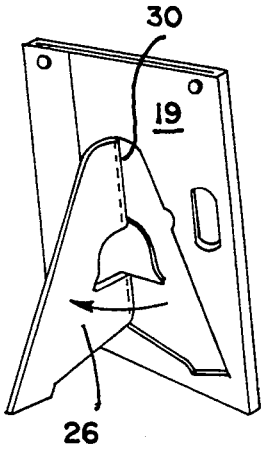
Fig. 5
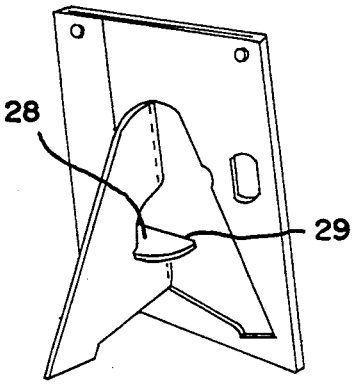
Fig. 6
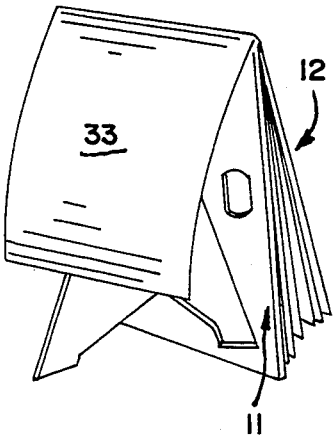

EASEL AND PAD PACK AND METHOD OF USE

BACKGROUND AND SUMMARY OF INVENTION

This invention relates to an easel and pad pack and method of using the same and, more particularly, to a device wherein an easel pad is first confined for travel in a holder and later, at the time of use, the holder can be reconfigured to provide a stand-up easel with the pad draped thereover.

The idea of making an easel type stand for tablets or calendars is quite old—see, for example, U.S. Pat. No. 433,635. Over the years, the idea of providing a mount for a display, i.e., an easel, has been the subject of considerable work—see, for example, U.S. Pat. Nos. 3,226,863; 3,370,368 and 4,143,847. None, however, provide the unique combination of advantages provided by the instant invention.

According to the instant invention, first and second four sided planar panels, which are constructed of paperboard, are closed at least temporarily on all four sides to provide an openable pack containing an easel pad. One of the panels is equipped with a generally L-shaped cut which can be pivoted out of the plane of the panel to provide a stand, and further, opening means are provided on one of the panels for hand insertion to carry the pack.

Other objects and advantages of the invention may be seen in the details of construction and operation as set forth in the ensuing specification.

BRIEF DESCRIPTION OF DRAWING

The invention is described in conjunction with the accompanying drawing, in which:

FIG. 1 is a perspective view of the invention in its traveling mode;

FIG. 2 is an enlarged fragmentary sectional view such as would be seen along the sight line 2—2 applied to FIG. 1;

FIG. 3 is a fragmentary sectional view of a portion of the device of FIG. 1 such as would be seen along the sight arrows 3—3 applied to FIG. 1;

FIG. 4 is a perspective view of the device of FIG. 1 with the stand means being pivoted out of the plane of the back panel;

FIG. 5 is a view similar to FIG. 4 but showing brace means being folded into position so to secure the stand from movement back into planar relation;

FIG. 6 is a view showing an easel pad mounted on the easel stand and ready for use;

FIG. 7 is a view similar to FIG. 3 showing an alternative arrangement for mounting the easel pad on the easel;

DETAILED DESCRIPTION

Figures 8, 9:
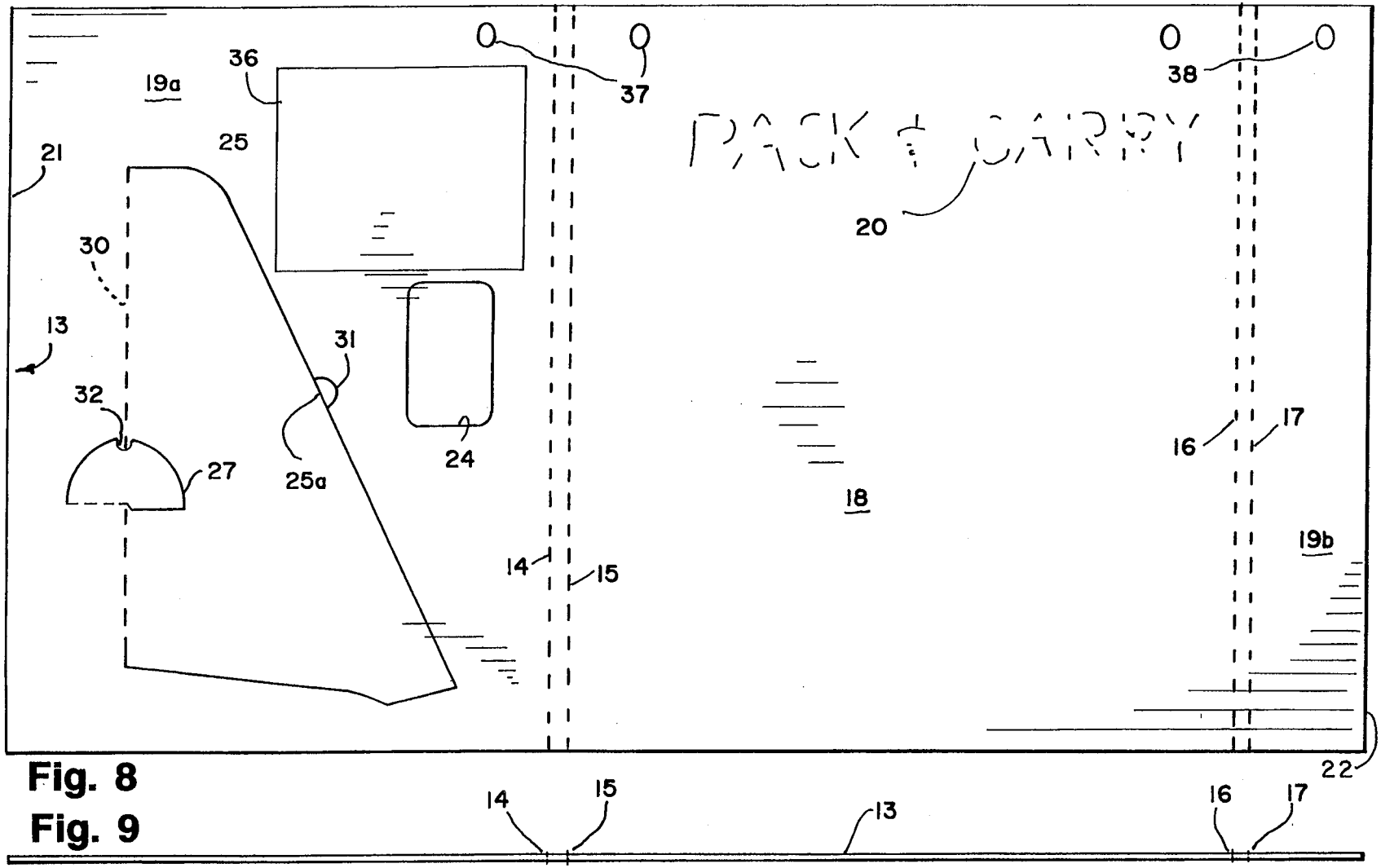
FIG. 8 is a plan view of the blank used for forming the pad holder.
FIG. 9 is an end elevational view of the blank of FIG. 8.

In the illustration given and with reference first to FIG. 1, the numeral 10 designates generally the inventive easel and pad pack. The pack 10 includes first a holder 11 and a pad 12—see particularly FIGS. 2 and 3. The holder 11 is developed from a blank 13 (see FIG. 8) which advantageously may be constructed of double-faced corrugated paperboard.

The blank 13 is relatively elongated and has spaced-apart pairs of lines of potential folding as at 14, 15 and 16, 17—still referring to FIG. 8. When the blank is folded along the pairs of lines, a holder is developed which has a front panel 18 and a rear panel 19—see FIG. 2.

The front panel 18 extends from the upper fold line 15 to the lower line 16—see FIG. 8. It carries printed indicia as at 20 featuring the product name, manufacturer, etc. The rear panel 19 is in the illustration given, made up of two portions **19*a*, 19*b*—see FIG. 8. As seen in FIG. 1, these portions have abutting edges 21, 22. The portions adjacent the edges are united in co-planar relation by adhesive equipped tape 23. The tape 23 extends around one pair of sides at 23*a*, see the lower right hand portion of FIG. 1. It also extends around the opposite side to temporarily secure the panels together. However, this part 23*b* of the tape has been severed by knife 24 to provide access to the interior or pocket 11*a*—see FIG. 2. Also, in FIG. 2 it is seen that the tape extends over a portion of the front panel 18, as at 23*c***. For this purpose, it is advantageous to use a transparent, pressure sensitive tape.

The rear panel 19, as can be quickly appreciated from a consideration of FIG. 1, is equipped with an opening 24 providing means for hand insertion to carry the composite pack 10 consisting of the holder 11 and pad 12.

In the illustration given, there is provided a generally L-shaped cut 25 in the panel 19 which serves to develop a stand 26—see FIG. 4. A generally C--shaped cut 27 (see FIG. 1) is provided to develop a brace 28 (see FIG. 5) by folding the brace 28 around a fold line 29. In similar fashion, the stand 26 is developed by folding the stand around the fold line 30 (see FIGS. 1 and 4).

Facilitating the pivoting of the stand 26 out of the plane of the panel 19 is a finger cut-out 31—see the central part of FIG. 1. This permits a finger to engage the part **25*a* (see FIG. 8) of the cut 25 for pulling the stand 26 into the FIG. 4 condition. Facilitating the stabilization of the stand 26 by the brace 28 is a notch 32 in the C-shaped cut 27—see FIG. 8. The notch is aligned with the fold line 30. By going through the steps of FIGS. 4 and 5, the now-erected easel stand can be employed in the fashion illustrated in FIG. 6 where the pad 12 rests against the holder 11 and pages are flipped over as indicated at 32. Alternatively, as seen in FIG. 7, the pad 12 (which is equipped with a stiff back 34) may be positioned so that the back 34 is within the pocket 11*a* and the sheets draped over the front as at 35**.

Pack-Forming Blank

To better understand the construction of the folder or carrier pack, reference is now made to FIGS. 8 and 9. Initially, a blank of double-faced corrugated paperboard having dimensions of about 45 inches by 25 inches is provided. This can be printed in a number of places, particularly as at 36 where instructions for the use of the travel easel and pad can be set down. These could include printed instructional indicia such as the following:

1. Use watercolor markers to minimize "bleed through".
2. Highlight key points with bold, large letters.
3. Use a variety of colors for visual impact.
4. Leave blank pages to conceal next pages.
5. Steady easel with hand . . . add notes.
6. Fold bottom corners of alternating pages for easy "flipping".

7. Time your presentation . . . and practice.

Also, the blank generally designated 13 can be equipped with the hand opening 24, the generally L-shaped cut 25, the "3"-shaped cut 27 and a notch 31 to facilitate finger engagement of the stand 26. Still further, holes as at 37 and 38 may be provided in pairs for the purpose of hanging the pack 10—similar openings often being provided in the easel 12.

Also, the blank may be provided with parallel spaced-apart fold lines as at 14–17 so that the blank may be folded on itself so as to bring the end edges 21 and 22 into abutting relation. Once this is done and the easel pad 13 positioned in the interior of the now folded blank, a length of adhesive tape as at 23 (see FIG. 1) can be applied in overlapping relation to complete the pack. Advantageously, the tape 23 may extend around the sides of the panel 19 into overlapping relation with the panel 18 as is depicted in FIG. 2 at 23*c*.

Operation

When it is time to make the presentation utilizing the easel pad and stand, the tape 23 can be severed by a knife 24 (depicted schematically at the lower left of FIG. 1) and the pack rotated 90 degrees to the FIG. 3 position whereupon the pad 12 can be removed in the direction indicated by the arrow 39 (see the upper central portion of FIG. 3). Thereafter, a finger is inserted into the notch opening 31 and the stand 26 pivoted out of the plane of the panel 19 to the configuration shown in FIG. 4. Thereafter, the brace 28 is pivoted out of the plane of the panel 19 to the FIG. 5 position wherein the notch 32 (see also FIG. 1) engages a portion of the stand 26.

If it is unnecessary or undesirable to retain the holder 11 for further use in transporting the pad, the holder may be opened by slicing the tape 23 along the mating line between the edges 21, 22.

What is claimed is:

1. An easel and pad pack comprising: a pack having only first and second spaced apart four sided planar panels constructed of paperboard to provide relatively stiff surfaces, means closing said first and second panels at least temporarily on all four sides to provide an operable holder having an interior pocket, and easel pad confined within said pocket, one of said first and second panels being equipped with a cut defining stand means for pivotal movement out of the plane of said panel to provide support for said on panel, and opening means on one of said first and second panels for hand insertion to carry said pack.

2. The pack of claim 1 in which said cut and said opening means are in the same panel, said pack including a unitary blank folded on itself along spaced pairs of transverse lines to space said panels apart.

3. The pack of claim 2 in which at least one of said panels is equipped with printed instructional indicia visible from the outside of said pack.

4. The pack of claim 2 in which at least one of said panels is equipped with instructional indicia extending parallel to one side, said stand means having a base extending parallel to said one side.

5. An easel and pad pack comprising: first and second four sided planar panels constructed of paperboard to provide relatively stiff surfaces, means closing said first and second panels at least temporarily on all four sides to provide an operable holder having an interior pocket, an easel pad confined within said pocket, one of said first and second panels being equipped with a cut defining stand means for pivotal movement out of the plane of said panel to provide support to said one panel, and opening means on one of said first and second panels for hand insertion to carry said pack, said holder including an elongated, generally rectangular, unitary blank folded on itself along spaced apart pairs of transverse lines to provide two of said sides, said blank having end edges butted together, and adhesive-equipped tape extending along said butted edges to unite said butted edges, said tape extending around the other two sides of said pack.

6. An easel and pad pack comprising a pack having only first and second generally rectangular, spaced apart planar panels constructed of paperboard to provide relatively stiff surfaces and having two pairs of opposite sides, means closing said first and second panels temporarily on two opposite sides to provide an openable holder, said first and second panels being integral on the other two sides, an easel pad removably confined within said panels, said first panel being equipped with a generally L-shaped cut defining stand means and arranged for pivotal movement out of the plane of said first panel to provide support for said holder, said first panels also being equipped with a generally C-shaped cut adjacent said L-shaped cut and defining brace means for stabilizing said stand means in non-planar relation to said first panel, and opening means in said first panel for hand insertion to carry said pack.

7. Method of conducting an easel presentation comprising the steps of:

providing a generally rectangular holder having only a pair of panels arranged to face to face, spaced apart relation and at least temporarily secured together to provide an internal pocket, providing an easel pad in said pocket and equipping one of said panels with a generally L-shaped cut defining stand means, providing one of said panels with a hand carrying opening, carrying the pad-equipped holder to a site of presentation, pivoting said stand means out of the plane of said panel to erect said holder in freestanding condition and substantially simultaneously therewith removing said pad from said pocket, and draping said pad over the freestanding holder.

* * * * *